United States Patent [19]

Secrist et al.

[11] Patent Number: 4,495,049

[45] Date of Patent: Jan. 22, 1985

[54] ANODE FOR MOLTEN SALT ELECTROLYSIS

[75] Inventors: Duane R. Secrist, Elizabethton; James M. Clark, Johnson City, both of Tenn.

[73] Assignee: Great Lakes Carbon Corporation, New York, N.Y.

[21] Appl. No.: 554,068

[22] Filed: Nov. 21, 1983

Related U.S. Application Data

[63] Continuation-in-part of Ser. No. 491,089, May 3, 1983.

[51] Int. Cl.[3] ..... C25B 11/04

[52] U.S. Cl. ..... 204/292; 204/291

[58] Field of Search ..... 204/291, 292, 67; 264/61; 79/230, 232, 234, 246

[56] References Cited

U.S. PATENT DOCUMENTS

| | | | |
|---|---|---|---|
| 4,155,758 | 5/1979 | Evans | 75/232 |
| 4,357,226 | 11/1982 | Alder | 204/286 |
| 4,374,050 | 2/1983 | Ray | 204/67 |
| 4,379,033 | 4/1983 | Clark | 204/67 |
| 4,399,008 | 8/1983 | Ray | 204/67 |

*Primary Examiner*—John F. Niebling

*Attorney, Agent, or Firm*—Adrian J. Good

[57] ABSTRACT

An electrode for an electrochemical cell comprising a variable cermet composition, the portion in contact with the electrolyte having a relatively high ceramic content for maximum corrosion resistance and the portion attached to the external electrical circuit having a relatively high metal content to facilitate an electrical connection. The electrodes vary in metal content from 5–80 vol. %, preferably 12–50 vol. %, either continuously or in graded steps. Preferred metals are Ni, Cu, Fe, and Cr; and preferred ceramics are ferrites.

7 Claims, 4 Drawing Figures

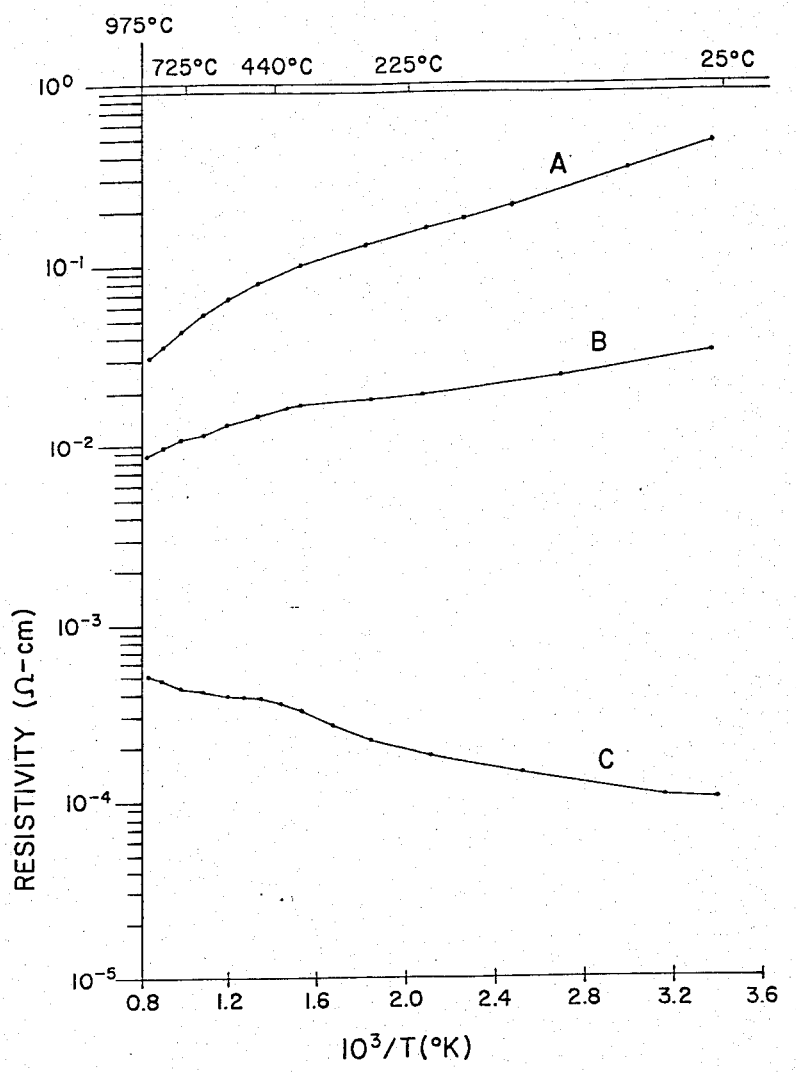
· Fig. 1 ·

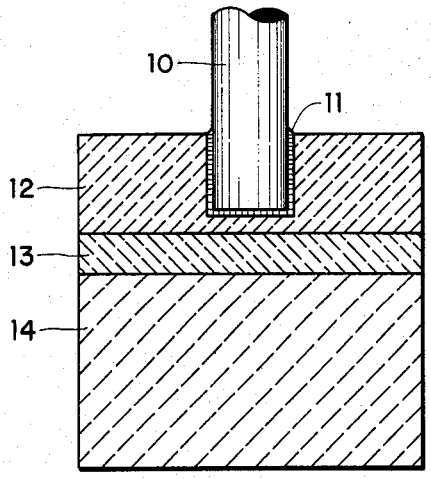
· Fig. 2 ·
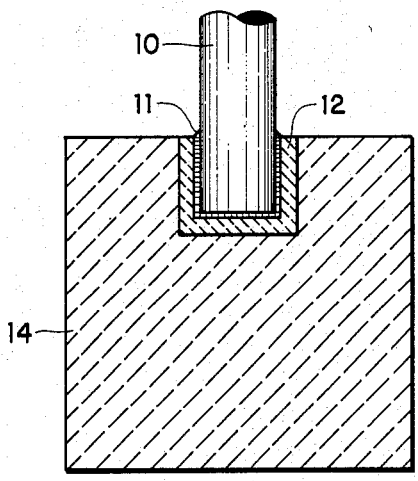
· Fig. 3 ·
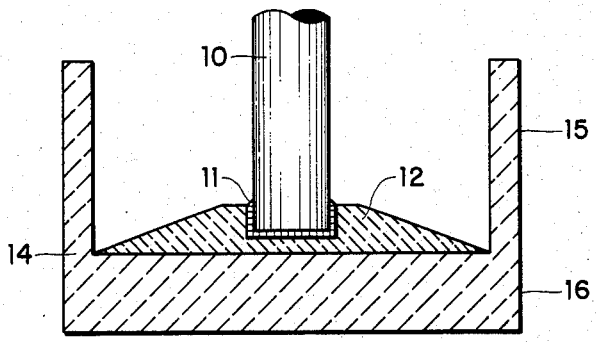
· Fig. 4 ·

ANODE FOR MOLTEN SALT ELECTROLYSIS

RELATED APPLICATIONS

This application is a continuation-in-part of our prior application Ser. No. 491,089 filed May 3, 1983 for ANODE FOR MOLTEN SALT ELECTROLYSIS.

BACKGROUND OF THE INVENTION

Aluminum is produced in Hall-Heroult cells by the electrolysis of alumina in molten cryolite, using conductive carbon electrodes as anodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the consumption of anode carbon are related to the cost of the anode consumed in the above reaction and to the impurities introduced into the melt from the carbon source. The petroleum cokes used in manufacturing the anodes usually have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon were consumed in the reduction the overall reaction would be $2Al_2O_3 \rightarrow 4Al + 3O_2$ and the oxygen produced could theoretically be recovered, but more importantly no carbon would be consumed at the anode and no contamination of the atmosphere or the product would occur from the impurities present in the coke.

Attempts have been made previously to use non-consumable anodes in aluminum reduction cells with little apparent success. Metals either melt at the temperature of cell operation, or are attacked by oxygen or by the cryolite bath. Ceramic compounds such as oxides with perovskite and spinel crystal structures usually have too high electrical resistance or are attacked by the cryolite bath.

One of the problems arising in the development of conductive ceramic anodes has been caused by the difficulty of making a durable electrical connection between the anode and the lead-in current conductor. Previous efforts in the field have produced connectors, constructed primarily of metals such as silver, copper, and stainless steel. Can, U.S. Pat. No. 3,681,506, discloses a resilient metal washer held in place to form an electrical connection. Davies, U.S. Pat. No. 3,893,821, discloses a contact material containing Ag, La, $SrCrO_3$ and CdO. Douglas et al., U.S. Pat. No. 3,922,236, disclose a contact material containing Ag, Cu, La, and $SrCrO_3$. Fletcher, U.S. Pat. No. 3,990,860, discloses cermet compositions containing stainless steel or Mo in a matrix of $Cr_2O_3$ and $Al_2O_3$. Shida et al., U.S. Pat. No. 4,141,727, disclose contacts of Ag, $Bi_2O_3$, $SnO_2$ and Sn. Schirnig et al., U.S. Pat. No. 4,247,381, disclose an electrode useful for $AlCl_3$ electrolysis comprising a graphite pipe, a metallic conductor with a melting point below the bath temperature, and a protective ceramic pipe surrounding the former. West German Pat. No. 1,244,343, U.S. Ser. No. 729,621, discloses borides or carbides of Ti, Zr, Ta, or Nb cast to Al using a flux of $Li_3AlF_6$, $Na_3AlF_6$ and NaCl. Alder, U.S. Pat. No. 4,357,226, discloses an anode assembly for a Hall cell comprising individual units mechanically held together by a clamping arrangement. U.K. patent application No. 2,078,259 published Jan. 6, 1982 (and equivalent U.S. Pat. No. 4,397,729 issued Aug. 9, 1983) describes the use of mixed oxides, alloys, composites and cermets including ferrites or chromites for use as inert anode materials. U.S. Pat. No. 4,374,761 issued Feb. 22, 1983 to S. P. Ray describes an inert electrode for electrolytic production of metals dissolved in molten salt comprising cermets containing metal powders including Ni and Cu. Our application, Ser. No. 475,951, filed Mar. 16, 1983, U.S. Pat. No. 4,443,314, discloses a cermet anode connector.

In non-consumable anodes, ceramics such as stannic oxide, ferrites, spinels, perovskites and various cermets are principal materials under study. A cermet is a composite material containing both metal and ceramic phases.

SUMMARY OF THE INVENTION

The conventional method of preparing cermet compositions is to mix metal and ceramic powders, cold press a preform, and sinter the preform at an elevated temperature in a controlled atmosphere. Alternatively, the cermet may be prepared by hot pressing or by hot isostatic pressing wherein the sintering operation is performed under pressure. Cermets have high electrical conductivity in comparison to ceramic compositions and good corrosion resistance when compared to metals. The reaction bonding which takes place between the cermet constituents during heat treatment alters the properties of the cermet in a synergistic fashion such that an improvement is realized over either of the metal or ceramic raw materials.

Our invention is a cermet non-consumable electrode useful for molten salt electrolysis and is particularly suitable as an anode for the electrolysis of alumina in a Hall-Heroult cell. The electrode functions as the active electrolytic element and is well adapted to carry current from the electrode current source to the electrolyte. The electrode itself is a metal-containing cermet of variable composition, with one end adapted for contact with a current conducting member for connection to the external electrical circuit having a relatively high metal content facilitating a brazed, low resistance connection and with a high ceramic component content for corrosion resistance at the other end in contact with the electrolyte.

It has been shown in Hall cell experiments in our laboratory that optimum performance of the anode is obtained when the portion of the anode in contact with the electrolyte has a metal content less than 25% by volume. The portion of the anode which is to be brazed to the current conducting member must be wetted by the braze metal and should, therefore, have a metal content greater than 30 volume % and preferably greater than 40 volume % but should not exceed 80%. Both of these requirements can be met in a monolithic anode by making an anode of variable composition with the portion in contact with the electrolyte having preferably at least 75% and not more than 95% by volume ceramic and the portion in contact with and brazed to the anode riser bar or other current conductor having more than 30% and preferably 40% to not more than 80% by volume metal, and 20 to 60 vol. % ceramic. The differentiation between the volume fractions of metal and ceramic phases is done by gradient, for example, by filling the mold sequentially in stages with two or more of the varied compositions. An anode prepared as described has the additional advantage that ohmic losses are reduced during operation of the anode as a result of the increasingly higher metal content in the direction of the current member.

For use in a Hall-Heroult cell, a cermet must have good conductivity across a wide temperature range, good oxidation stability, and high corrosion resistance. Metal-metal oxide combinations are desirable for long term use, but cermets with a non-oxide ceramic phase may also be useful provided the oxide which forms on the surface of the cermet during operation at high temperature is sufficiently electrically conductive and corrosion resistant.

The cermets are prepared conventionally by blending the ceramic powder with a metal. A cermet anode may be fabricated by sequentially forming layers of ceramic and metal powder mixtures with varying compositions and isostatically pressing at about $5-30\times10^7$ Pa to yield a graded body. The graded body is then sintered in an inert atmosphere at a temperature above about 1100° C. effective to produce a physically strong part with low porosity, 8 vol. % or lower, and good electrical conductivity across a wide temperature range. Typically, cermets with ≧30 vol. % metal content exhibit conductivities approaching that of the metal phase while maintaining high corrosion resistance, provided that the cermet body is impervious, i.e., contains less than approximately 8 vol. % porosity.

We have found that cermet compositions with unusually high metal contents can be sintered to form dense, monolithic composite specimens. This property of the cermet materials is attributed to the high reactivity and ductility of the metal phase. In addition, we have discovered that two or more cermet compositions differing appreciably in metal content can be fabricated into monolithic anodes of variable composition which exhibit high strength and high electrical conductance when placed in the cell operating environment. The compatibility of the compositions is reflected in the small difference observed for the average coefficients of thermal expansion of, for example, $Ni/(MnZn)Fe_2O_4$ cermet materials containing 16 vol. % Ni and 40 vol. % Ni, being $13.1\times10^{-6}$ °C.$^{-1}$ and $13.6\times10^{-6}$ °C.$^{-1}$, respectively, over the temperature range 20°-900° C.

Our method may be used to produce electrodes varying in metal content from 5-80 vol. %, preferably 12-50 vol. %, across their length, either continuously or in graded steps. In a preferred structure, the working portion of the anode consists of from 75 to 88% by volume of a ceramic phase and the non-working brazable portion consists of at least 40% and not more than 50% by volume metal phase.

We may also vary the composition of the electrodes by using different metals or alloys at the two opposite portions, the metals most commonly used being Ni, Cu, Fe, and Cr. Thus, we may in some instances use a Cu-ceramic cermet at the end connected to the current source and an Ni-ceramic cermet at the electrolyte-contacting portion for corrosion resistance. We may also vary the ceramic used from those highly corrosion resistant to those more conductive, or varying in other properties.

Our electrodes may have many other applications in addition to those in the Hall-Heroult cell, as in the production of the electrolytic elements and compounds, e.g., Mg, Cu, Zn, Na, Cl, NaOH, Ag, Au, and Pt are produced or refined electrolytically, and acrylonitrile is dimerized to adiponitrile. Our electrodes may also be useful in fuel cells for the conversion of chemical to electrical potential. These cells have electrode requirements similar to those of molten salt electrolytic cells, namely, the electrodes must possess adequate corrosion resistance, electrical conductivity and connectability.

DETAILED DESCRIPTION OF THE INVENTION

Cermet bodies comprising progressively varying amounts of metal-ceramic compositions can be fabricated according to our invention. The finely divided ceramic compound which may be one or more of the metal oxides which have previously been disclosed in the prior art for non-consumable anodes is mixed with varying amounts of finely divided metal (≦44 micron particle size) which metal can be nickel, copper, iron, chromium and equivalents for this purpose. The mixtures are dry blended and isostatically pressed followed by sintering in vacuum, argon or nitrogen for 2-30 hours at 1225°-1350° C. to produce a dense low porosity article. The metal content should be in the range of 5-80 vol. %, preferably 12-50 vol. %, with the highest metal content at the upper end of the anode which is connected to a lead-in current conductor, and the highest ceramic content being at the opposite operating end of the anode. The anode can be formed by using a multiple series of mixed powders having varying metal content by placing them in a mold and adding several layers of the mixture to form discrete sections of increasing metal content as the sections approach the top of the anode. Following this, the contents of the mold are suitably compacted, preferably by isostatic pressing, and then heated to a temperature sufficiently high to sinter all of the layers thereby resulting in an anode with structured continuity. Following the sintering operation, the lead-in electrical conductor can be implanted at the upper, metal-rich end of the anode by drilling a suitable recess and implanting the conductor therein using a brazing technique to achieve the connection. Alternatively, the upper end of the anode can be tapped and threaded to receive a correspondingly threaded lead-in conductor.

Instead of employing a large number of mixtures of ceramic and metal powders, the anode can be constructed and graded by sequential steps consisting of two or more layers of powdered ceramic-metal compositions of different metal content in which the lower most portion or layer is characterized by a comparatively low metal content and the upper layer composition contains more metal than the lower layer.

Various modifications of the electrode of our invention are shown in FIGS. 1, 2, 3 and 4 of the accompanying drawings.

In the embodiment shown in FIG. 2, the electrode assembly consists of a current lead-in conductor 10 connected by brazing 11 to the top of an electrode consisting of a metal-rich cermet 12 upper portion overlaying and sintered to an intermediate portion 13 which is less rich in metal and higher in ceramic component than portion 12, and a lower portion 14 sintered to the intermediate portion 13 and being still lower in metal content than intermediate portion 13.

In the embodiment shown in FIG. 3, the electrode consists of a metal-rich cermet upper portion 12 which is in the shape of a cup or hollow cylinder open at its upper end to receive the lead-in conductor 10, using a brazed connection 11. The outside surface of the cup 12 is sintered to and surrounded by an outer electrode cermet portion 14 which is lower in metal content than the cup portion 12.

In the embodiment shown in FIG. 4, the electrode consists of a metal-rich tapered upper portion 12 containing a cavity adapted to receive the lead-in conductor 10 using a brazed connection 11. The upper portion 12 is sintered to a lower electrode cermet portion 14 which is lower in metal content than the upper portion 12. The lower electrode portion 14 is characterized by being in the shape of a trough (if it is rectangular) or a cup or cylinder (if it is circular) having vertical walls 15 protruding upwardly from a base section 16, the base and walls being usually, but not necessarily, of the same composition.

The embodiments shown in FIGS. 2, 3 and 4 can be fabricated using one or more of the procedures described in the following Examples.

Examples 1–6 below are electrodes of uniform composition while Examples 7–13 are of variable composition according to the invention.

EXAMPLE 1

A ceramic powder of composition $(MnZn)Fe_{2.04}O_4$ was prepared by wet milling a mixture of $MnCO_3$, ZnO, and $Fe_2O_3$. After drying, the powders were calcined in air at 1000° C. for 2 hours to yield a final ferrite composition corresponding to 52 mol. % $Fe_2O_3$, 25 mol. % MnO, and 23 mol. % ZnO. A cermet anode was fabricated by dry blending the calcined ceramic powder with 16 vol. % of ≦40 micron size nickel powder, isostatically molding a preform of the mixture, and sintering the preform in vacuum for 6 hours at 1225° C. to produce a specimen 95% dense and measuring 3.8 cm. in diameter. Examination of the microstructure of the cermet material revealed one nickel-iron metal phase and three ceramic phases consisting of mixed ferrites or solid solutions of Mn ferrite, Ni ferrite, and Zn ferrite. The X-ray diffraction lines most closely matched those of nickel zinc ferrite, with several strong lines unidentifiable.

The anode was tested for 65 hours in an aluminum reduction cell in acidic cryolite at 970° C., the melt having a weight ratio of 1.2 and containing 7% $CaF_2$ and excess $Al_2O_3$. A current density of 1 amp/cm$^2$ was imposed on the sample using the area of the tip of the anode as the basis for the current density calculation. The anode was supported with platinum wires. No operating difficulties were encountered, with the anode voltage stable throughout the test. At the end of the test period, the axial dimension had lost 0.53 mm for an effective corrosion rate of 71 mm/yr.

EXAMPLE 2

The test of Example 1 was repeated using the same percentage composition with Ni powder of nominal 1 micron particle diameter. After 100 hours of testing, the axial corrosion rate was 66 mm/yr.

EXAMPLE 3

Cermet samples containing 16, 25, and 40 volume % Ni and the remainder MnZn ferrite were fabricated for electrical resistivity characterization. Measurements were taken over the temperature range 25°–950° C. using platinum probes and contacts in a 4-terminal arrangement. A plot of log resistivity versus reciprocal temperature for the cermets is shown in FIG. 1. The measurements were made in air. It is evident from the figure (curves A and B) that the compositions containing 16 and 25 volume % Ni have negative temperature coefficients, characteristic of semiconducting oxides, while the 40 volume % Ni cermet (curve C) has a positive temperature coefficient, indicative of metallic behavior. The internal stability of all three cermets at 950° C. in air was demonstrated by noting that the resistivities remained constant for periods ≧40 hours. The cermet containing 40 volume % Ni has a resistivity at 950° of $5\times10^{-4}\Omega$.cm, one-tenth that of anode carbon at the same temperature. A polished specimen of this cermet was examined with the electron microscope and observed to be very dense and to possess an extended internal metal network accounting for the metallic electrical properties.

EXAMPLE 4

A nominal one-inch diameter cermet anode having a composition of 16 vol. % Ni/84 vol. % $CuFe_2O_4$ was fabricated as follows:

Appropriate quantities of CuO and $Fe_2O_3$ powder were blended and then calcined at 1000° C. in air to form $CuFe_2O_4$, a spinel ferrite. Nickel metal (−325 mesh particle size) in the above proportion was mixed with the $CuFe_2O_4$ powder and the mixture isostatically pressed into a cylindrical pellet. The pellet was sintered in $N_2$ at 1300° C. for four hours to yield an anode with a density of 5.415 g/cm$^3$. The anode was electrolyzed at a current density of 1.0 A/cm$^2$ in a 1.2 cryolite ratio Hall melt containing 7 wt. % $CaF_2$ and 8.5 wt. % $Al_2O_3$. After 24 hours of electrolysis, the axial corrosion rate was measured and found to be 56 mm/year.

EXAMPLE 5

A cermet anode containing an alloy metal phase was produced in the laboratory by blending fine powders of Cu metal, Ni metal, and $NiFe_2O_4$ ferrite in a proportion equivalent to 16 vol. % (70 wt. % Cu; 30 wt. % Ni)/84 vol. % $NiFe_2O_4$. The blended powders were isostatically molded into a cylindrical pellet and the pellet sintered at 1225° C. in vacuum for six hours to form a one-inch diameter anode with a density of 5.848 g/cm$^3$. Electrolysis of the anode was conducted for 24 hours under the same test conditions as described in Example 4. The axial corrosion rate of the anode was measured as 28 mm/year.

EXAMPLE 6

A cermet anode of composition 16 vol. % Ni/84 vol. % $BaNi_2Fe_{15.84}Sb_{0.16}O_{27}$, a hexagonal ferrite, was prepared and tested as follows: an appropriate mixture of $Fe_2O_3$, $Fe_3O_4$, $BaCO_3$, $NiCO_3$ and $Sb_2O_5$ was wet milled for 6 hours. After drying, the material was granulated and calcined at 1250° C. for 6 hours in static air to pre-react the powder. The milling and drying steps were then repeated a second time. To this calcined powder, a quantity of 1 micron particle size nickel metal powder was added and the mixture dry blended for one hour. A cylindrically shaped pellet, 2.5 cm in diameter by 7.6 cm in length, was formed from the powder by isostatic molding at 138 MPa. The cylinder was sintered in vacuum for 6 hours at 1225° C. to produce a test anode with an Archimedes density of 5.37 gm/cm$^3$.

After 24 hours of electrolysis, the axial dimension of the anode was measured and found to have increased slightly by 0.27 mm.

EXAMPLE 7

A 3.6 cm long×3.8 cm diameter cermet anode was fabricated as follows: Cermet compositions containing 16, 25, and 40 vol. % nickel metal were prepared by dry blending one micron size metal powders with calcined powders of MnZn ferrite. A layer of the 16 vol. % Ni cermet was placed in a cylindrical mold followed, in turn, by a layer of the 25 vol. % Ni cermet and a layer of the 40 vol. % Ni cermet. To preserve the definition of the graded layers, the mold was compacted at $6.9\times10^7$ Pa in a uniaxial mechanical press prior to final isostatic pressing at $1.4\times10^8$ Pa. The green body was sintered in vacuum for 2 hours at 1225° C. to yield a 98% dense anode based on an estimated theoretical density of 6.133 g/cm$^3$. The diameter of the sintered anode varied from 3.85 cm at the high metal end to 3.70 cm at the low metal end, a difference of 4%. The differential shrinkage was accommodated with no evidence of external structural defects.

A 1.9 cm diameter 70/30 copper-nickel alloy rod was brazed to the high metal end of the anode to form a low resistance solid state connection. The brazing operation was carried out by placing the rod atop a layer of copper powder (m.p. 1083° C.) in contact with the sintered anode and firing the assembly in vacuum to 1125° C. for 30 minutes to melt the braze metal. The resulting joint was strong. Sectioning of the anode confirmed the intimate contact (low wetting angle) of the braze metal and the cermet; the layers of cermet material within the anode were strongly reaction bonded with no sign of delamination at the interfaces.

EXAMPLE 8

Nickel/MnZn ferrite cermet compositions containing 16, 22, 28, 34, and 40 vol. % Ni were prepared by dry blending the constituent powders for one hour. A graded cermet anode was formed from the powders by filling a cylindrical mold sequentially with a 3.8 cm thick layer of the 16 vol. % Ni cermet, 1.3 cm thick layers of the 22, 28, and 34 vol. % Ni cermets, and finally a 3.8 cm thick layer of the 40 vol. % Ni cermet. The molded powders were isostatically pressed at $1.4\times10^8$ Pa to form a green anode body. A 2.5 cm diameter hole, 2.5 cm deep, was drilled in the metal rich end of the anode to accommodate a metal stub. The anode was densified by sintering in vacuum for 6 hours at 1225° C.; the sample measured 7.6 cm in length and 4.2 cm in diameter. A 70/30 copper-nickel alloy stub, 1.9 cm in diameter, was brazed to the metal rich end of the anode by inserting the stub into the prepared hole, filling the annular void space around the stub with copper metal powder, and firing the complete assembly in a vacuum furnace to 1125° C. for 30 minutes to effect a solid state connection.

The integrity of the anode assembly was evaluated by exposing the anode and joint to Hall reduction cell conditions in a 24 hour test. Electrical connection of the anode to the bus bar was made by welding the anode stub to the positive current lead. The tip of the anode comprising the 16 vol. % Ni/MnZn ferrite material was immersed to a depth of 2.5 cm in a melt containing $Na_3AlF_6$ and excess $AlF_3$ (1.2 weight ratio) with 7 wt. % $Al_2O_3$ and 7 wt. % $CaF_2$. The melt temperature was 970° C. The anode was electrolyzed at a current density of approximately 1 amp/cm$^2$ or 20 amps total anode current.

During the test, the temperature at the top of the anode joint was measured to be 930° C., several hundred degrees greater than that the joint is expected to experience during commercial operation. Thus the described conditions represent a severe test of the integrity of the joint. When the test was terminated, the anode assembly was observed to be in excellent condition. A continuity measurement of the joint showed that no increase in resistance had occurred during anode operation.

EXAMPLE 9

A cylindrical mold was filled with powders of two different Ni/MnZn ferrite cermet compositions with the powders segregated so that the lower half of the mold contained a 16 vol. % Ni cermet and the upper half a 40 vol. % Ni cermet. The powders were isostatically pressed at $1.4\times10^8$ Pa to yield a green anode body 6 cm in diameter and having a graded cermet composition. A 2.5 cm diameter hole, 2.5 cm deep, was then drilled in the metal rich end of the cermet. A 1.9 cm diameter×1.0 cm thick disk of 70/30 coppernickel alloy metal (m.p. 1240° C.) was placed in the bottom of the hole and a 1.9 cm diameter Monel 400 cylindrical stub (m.p. 1349° C.) placed on top of the disk. The complete assembly was fired in vacuum to 1225° C. and allowed to soak for 6 hours to densify the cermet anode. The temperature was then raised to 1265° C. for approximately 20 minutes to melt the braze metal after which the assembly was cooled to room temperature in 8 hours. The anode body sintered to high density and was structurally sound. The metal stub was joined securely to the sintered anode via the braze metal.

The tip of the anode was immersed to a depth of 1.9 cm in a cryolite-$CaF_2$-$Al_2O_3$ melt at 970° C. and the anode electrolyzed at 2.0 amps/cm$^2$ current density for 98.5 hours. The integrity of the anode was unaffected by the introduction of the anode into the cell, the extended electrolysis period, and the withdrawal of the anode from the cell illustrating that cermet compositions differing appreciably in metal content can be fabricated into monolithic anodes which exhibit high strength at operating temperature.

When incorporating the anode sintering and brazing steps in a single firing, as described, a knowledge of the shrinkage characteristics of the cermet material is essential in order to properly dimension the braze cavity.

EXAMPLE 10

A large cylindrical anode measuring 8 cm in diameter by 5 cm long was fabricated by sequentially forming layers of Ni/(MnZn)$Fe_{2.04}O_4$ cermet powders containing 25.0, 32.5, and 40.0 vol. % Ni, isostatically pressing the powders at $1.4\times10^8$ Pa to form a compacted body, and sintering the body at 25° C. per hour to 1225° C. for 6 hours in nitrogen. The anode was cooled to room temperature at 25° C. per hour. The sintered anode was >95% dense and was free of structural defects. A 2.5 cm diameter by 3.8 cm long Monel 400 stub was brazed to the anode using 70/30 copper-nickel alloy as the braze metal. The stub was inserted into a 2.0 cm deep cavity in the metal rich end of the anode, the braze metal placed about the stub, and the complete assembly fired to 1265° C. in nitrogen to effect the connection to the anode.

The anode was electrolyzed for 96 hours at a current density of 0.9 A/cm$^2$ in a 1.2 ratio Hall melt containing 5 wt. % $CaF_2$ and >8 wt. % $Al_2O_3$. The brazed joint performed well throughout the test as evidenced by the low, stable cell voltage (3.8 volts at 49 amps current). The working cermet material corroded axially at a rate of 94 mm/year.

EXAMPLE 11

A cermet anode with a brazable insert patterned after the assembly shown in FIG. 3 was fabricated as follows:

Two cermet compositions were prepared, one a 16 vol. % Ni/84 vol. % $NiFe_{2.04}O_4$ cermet to function as the lower active anode material and the other a 40 vol. % Ni/60 vol. % $NiFe_{2.04}O_4$ cermet to function as the upper brazable material. A small pellet of the 40 vol. % Ni/60 vol. % $NiFe_{2.04}O_4$ was first produced by isostatically molding the cermet powder at 103 MPa. The pellet was placed in a mold and the remainder of the mold filled with the 16 vol. % Ni/84 vol. % $NiFe_{2.04}O_4$ powder such that the powder surrounded all but one end of the pellet. The powder and encased pellet were then pressed at 124 MPa to form a cylindrical anode preform with a brazable insert. The double pressing operation can be simplified to a single pressing operation by loading the mold with powders of both compositions while using a separator to preserve the two composition domains. After the mold is loaded, the separator is removed. A ¼" diameter hole to accommodate the electrical connector rod was drilled approximately one inch deep into the insert. The sample was then sintered for 30 hours at 1325° C. in vacuum to produce an anode of variable composition measuring approximately 3.25 cm in diameter and 7.25 cm in length. A Monel 400 rod was brazed to the insert with 70 Cu-30 Ni alloy by firing to 1265° C. for 20 minutes in vacuum.

The anode was electrolyzed at 1.0 amp/cm$^2$ current density for 96.0 hours in a Hall melt contained in a graphite test crucible lined with a sintered alumina insulating sleeve. A continuous aluminum pad served as the cathode. The acidic cryolite melt contained 5 wt. % $CaF_2$ and 8.5 wt. % $Al_2O_3$, the $Al_2O_3$ being replenished on a continuous basis. The aluminum produced during the test was analyzed and found to contain 0.60 wt. % Fe and 0.15 wt. % Ni based on 90% cell efficiency. The anode and brazed joint demonstrated high integrity and ohmic losses were low through the anode and electrical connection.

EXAMPLE 12

Two cermet compositions with different metal constituents were prepared in the following manner. Quantities of NiO and $Fe_3O_4$ were blended thoroughly and then dry mixed with a quantity of Fe metal to produce a powder having a composition of 20 wt. % Fe/80 wt. % $NiO.Fe_3O_4$. This material was used for the active lower portion of the electrode. To produce the material for the brazable upper portion of the electrode, a quantity of Ni metal powder was mixed with the active electrode composition to yield a powder having a nominal composition of 35.7 wt. % Ni, 12.9 wt. % Fe, 51.4 wt. % $NiO.Fe_3O_4$. A cylindrical preform comprising a working portion and a brazable portion was formed by isostatically pressing the segregated powders at 138 MPa. A ¼" diameter hole was drilled into the brazable upper end for the current member, and the preform was sintered in $N_2$ at 1350° C. for 24 hours. The final product was an electrode of variable composition. A Monel 400 current member was brazed to the upper metal-rich end of the electrode with 70 Cu-30 Ni alloy by firing to 1265° C. for 20 minutes in vacuum.

The electrode was electrolyzed for 85.0 hours as an anode under conditions identical to those described in Example 10. The aluminum metal produced during the test contained 1.12 wt. % Fe and 0.25 wt. % Ni, corrected to 90% cell efficiency. The electrical characteristics of the anode and joint were unchanged throughout the test as evidenced by the stable current and voltage curves.

EXAMPLE 13

A cermet electrode containing a complex oxide corresponding to $BaNi_2Fe_{15.84}Sb_{0.16}O_{27}$ is fabricated for testing. The oxide is first prepared by blending powders of $Fe_2O_3$, $Fe_3O_4$, $BaCO_3$, $NiCO_3$, and $Sb_2O_5$ and calcining the mixture at 1250° C. for 6 hours in air to pre-react the powders. Appropriate quantities of 1 micron particle size Ni powder are added to the oxide material to produce two cermet compositions, one composition equivalent to 16 vol. % Ni/84 vol. % $BaNi_2Fe_{15.84}Sb_{0.16}O_{27}$ and designated for the working portion of the electrode and the second composition equivalent to 40 vol. % Ni/60 vol. % $BaNi_2Fe_{15.84}Sb_{0.16}O_{27}$ and designated for the brazable portion of the electrode. The two materials are placed sequentially into a molding bag and then isostatically pressed at 138 MPa to form a green electrode. A small hole for the metal current member is drilled into the brazable end of the electrode prior to sintering at 1225° C. for 6 hours in vacuum. A Monel 400 rod is brazed to the metal-rich end of the electrode with 70 Cu-30 Ni alloy by firing to 1265° C. in vacuum for 20 minutes.

The electrode is expected to perform well when tested as an anode in a Hall cell melt, with the working portion possessing high corrosion resistance (see Example 6) and the electrode and joint exhibiting high strength and high electrical conductance.

It may be determined from the above that a non-consumable electrode for an electrochemical cell may be constructed as a physically monolithic material having a variable composition, the lower portion in contact with the electrolyte having high corrosion resistance and the upper portion connected to the external electrical circuit being wettable or brazable by a brazing composition. The end of the anode in contact with cryolite in a Hall-Heroult cell is high in ceramic content, while the end in contact with the current source is high in metal content. This principle may also be used in forming electrodes, both anodes and cathodes, for other molten salt cells, such as those used for production of Al by the electrolysis of $AlCl_3$, Mg production, and in forming electrodes for electrochemical cells in general involving a corrosive electrolyte.

We claim:

1. A permanent cermet anode for electrowinning of aluminum and other metals by molten salt electrolysis having one end attached to a current source and the other end in contact with the molten electrolyte, said ends having different compositions, the end attached to the current source having from 30% to 80% by volume of a metal selected from the group consisting of Cu, Ni, Fe, Cr and alloys thereof and from 20% to 70% by volume of a ceramic component, the end in contact with the electrolyte having from 75% to 90% by volume of a ceramic component and from 10% to 25% by volume metal selected from said group of metals, wherein the anode is formed by sintering a mixture of metal and ceramic powders to form a hard dense body substantially resistant to attack by the molten salt environment, wherein the metal content of said anode increases progressively from one end of the anode to the other, the end attached to the current source containing sufficient metal to render the cermet brazable to a lead-in current conductor and having a resistivity less than $1\times10^{-3}$ ohm-cm at 950° C., the end in contact with the electrolyte having a resistivity less than $1\times10^{-1}$ ohm-cm at 950° C. with a negative temperature coefficient of resistivity.

2. An anode suitable for electrowinning of aluminum and other metals by molten salt electrolysis formed by sintering a mixture of metal and ceramic powders to form a hard dense body substantially resistant to attack by the molten salt environment, wherein the metal content of said electrode increases progressively from one end of the electrode to the other, the working portion containing sufficient metal to render the cermet conductive, the non-working portion containing sufficient metal to render the cermet brazable to a lead-in current conductor, wherein the said working portion consists of from 75% to 90% by volume of a ceramic selected from the group consisting of MnZn ferrite, Ni ferrite, or $BaNi_2Fe_{15.84}Sb_{0.16}O_4$ and wherein said brazable portion consists of from 30% to 80% by volume Ni.

3. An anode assembly for the electrolysis of molten salts comprising a current lead-in conductor connected by brazing to the top of said anode consisting of a first metal-rich cermet upper portion overlaying and sintered to an intermediate second portion less rich in metal and higher in ceramic component than said first portion, and a lower third portion in contact with the molten electrolyte sintered to and having a lower metal content than said second portion.

4. An electrode for the electrolysis of molten salts consisting of a cermet body having a metal-rich upper portion in the shape of a cup or a hollow cylinder open at its upper end to receive a lead-in conductor using a brazed connection, the outer surface of said cup or cylinder sintered to and surrounded by an outer cermet portion lower in metal content than said cup or cylinder.

5. An electrode for the electrolysis of molten salts comprising a current carrying lead-in conductor brazed to a central cavity in metal-rich first cermet body in the shape of a truncated cone, said cermet body sintered to the lower interior surface of the base of a second metal-poor hollow cermet body in the shape of a cup or a trough having walls protruding upwardly from said base.

6. The anode of claim 1 wherein the ceramic component is selected from the group consisting of hexagonal ferrites and spinel ferrites.

7. The anode of claim 6 wherein the ceramic component is a magnetoplumbite.

* * * * *